US005823656A

United States Patent [19]

Waldmann

[11] Patent Number: 5,823,656

[45] Date of Patent: Oct. 20, 1998

[54] WIDE-DISPERSION LAMP ASSEMBLY

[75] Inventor: Gerhard Waldmann, Dauchingen, Germany

[73] Assignee: Herbert Waldman GmbH & Co., Germany

[21] Appl. No.: 731,080

[22] Filed: Oct. 9, 1996

[30] Foreign Application Priority Data

Oct. 10, 1995 [DE] Germany ..... 195 37 685.4

[51] Int. Cl.[6] ..... F21S 3/02

[52] U.S. Cl. ..... 362/147; 362/223; 362/225; 362/241; 362/248; 362/404; 362/414

[58] Field of Search ..... 362/217, 225, 362/223, 240, 241, 245, 247, 248, 249, 260, 404, 408, 410, 414

[56] References Cited

U.S. PATENT DOCUMENTS

| | | | |
|---|---|---|---|
| 2,306,700 | 12/1942 | Kantack | 362/225 |
| 2,759,094 | 8/1956 | Goddard et al. | 362/247 |
| 4,933,820 | 6/1990 | Engel | 362/225 |
| 5,276,597 | 1/1994 | Herst et al. | 362/225 |

FOREIGN PATENT DOCUMENTS

| | | | |
|---|---|---|---|
| 602537 | 7/1960 | Canada | 362/225 |
| 641632 | 5/1962 | Canada | 362/225 |

*Primary Examiner*—Alan Cariaso
*Attorney, Agent, or Firm*—Eugene E. Renz, Jr., PC

[57] ABSTRACT

A wide-dispersion indirect lamp assembly with an elongated lamp housing (14), symmetric to a central, vertical plane (26), and which prevents at least most of the light from escaping downward. The assembly includes two fluorescent tubes (28); and a reflector (30) above each of the tubes. Each reflector, seen in vertical cross section, slants upward and away from a point (32) on the upper half of the circumference of the fluorescent tube. The point (32) is preferably shifted away from the apex line (34) of the circumference of the fluorescent tube toward the central plane (26) of the lamp housing (14).

10 Claims, 2 Drawing Sheets

WIDE-DISPERSION LAMP ASSEMBLY

FIELD OF THE INVENTION

The present invention relates to lamps, and more specifically to improvements in wide-dispersion indirect lamp assemblies.

BACKGROUND OF THE INVENTION

In the case of so-called "short-suspension" hanging lamps, the distance between the ceiling and the lower edge of the lamp must be as small as possible for proper light dispersion. When lamps of this type are used in rooms with a ceiling height of less than 2.5 m it is necessary to have an unobstructed passage approximately 2.2 m in height underneath the lamp. Accordingly, when a lamp is suspended only a short distance from the ceiling as required, the intensity of the light at the ceiling will be high. This is inefficient for the purpose of illumination. The same problem exists in connection with floor lamps with very tall stands when the lamp at the end of the stand itself is close to the ceiling.

Short-suspension hanging lamps including those with reflectors of various designs are not new per se. For example, German Utility Model Patent No. 74-14,939 and 89-08-742 and Swiss Patent No. 193,757 are examples of prior art lamps of this type. These lamps, however, do not provide a satisfactory solution to the problem noted above. In Germany Utility Model Patent No. 74-14,939, a reflector is provided underneath each of the florescent tubes to direct the light of the tube upwardly.

SUMMARY OF THE INVENTION

With the above in mind, it is an object of the present invention to provide an improved lamp of the general type described above which is characterized by novel features of construction and arrangement whereby light of excessive intensity at the ceiling directly above the lamp is avoided and wherein a substantial portion of the radiated light is emitted laterally and obliquely upwardly, thereby to illuminate effectively and uniformly. To this end, in accordance with the present invention, the elongated lamp housing mounts fluorescent tubes on either side of a vertical plane and at least one reflector in the lamp housing next to and parallel to each fluorescent tube. Each reflector slants upwardly and away from the central plane from a point on the upper half of the circumference of the associated fluorescent tube. Accordingly, since the upwardly and outwardly slanting reflectors are mounted directly above the fluorescent tube, the major portion of light is diverted laterally and upwardly over a wide angle whereas only the light emerging upwardly on the interior side of the reflector toward the central plane of the lamp housing suitably illuminates the ceiling area located directly above the lamp housing.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

Figure 1:
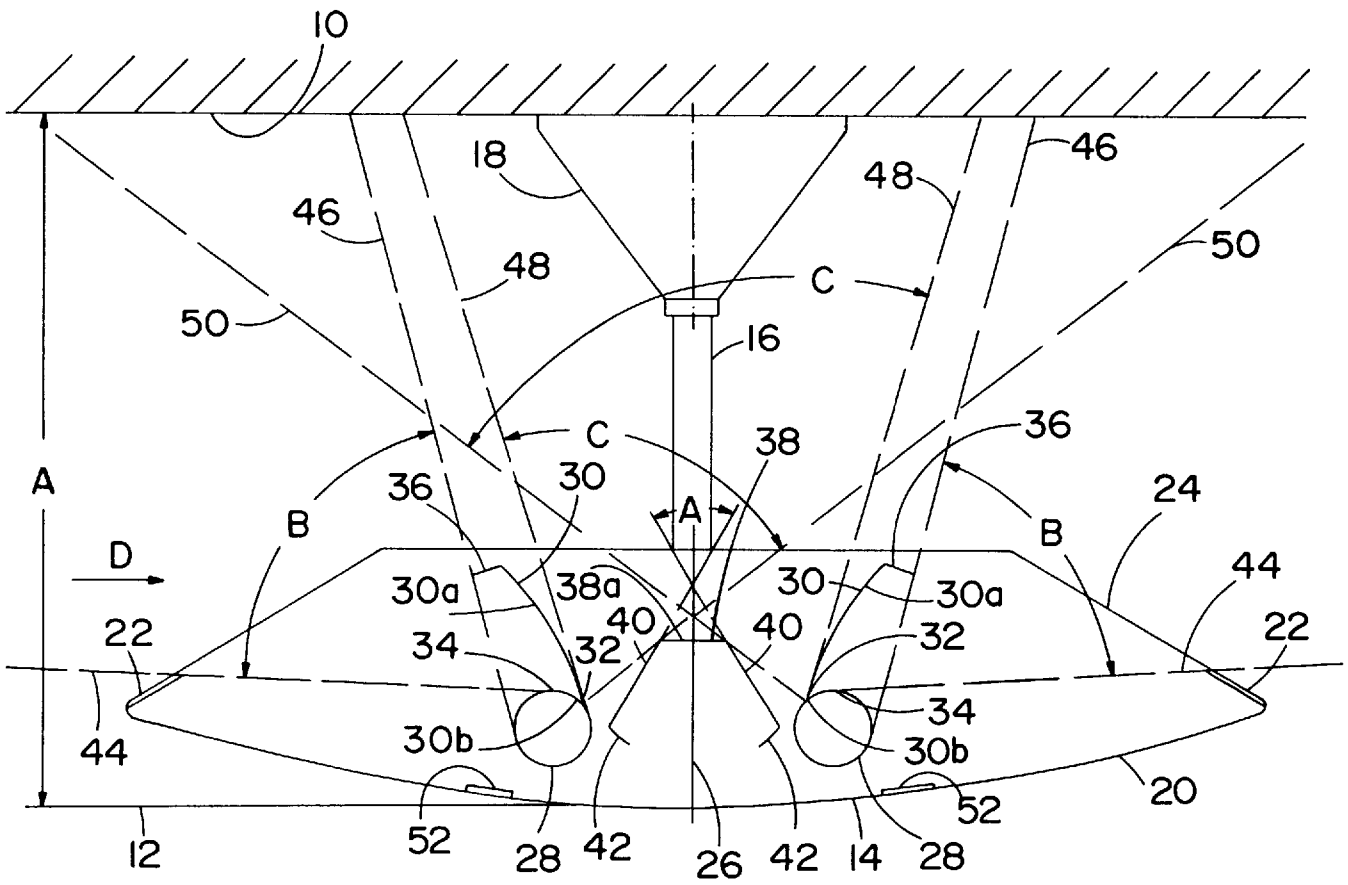
FIG. 1 is a schematic cross sectional view perpendicular to the longitudinal direction of a lamp assembly in accordance with the present invention suspended a short distance away from the ceiling of a room.
Figure 2:
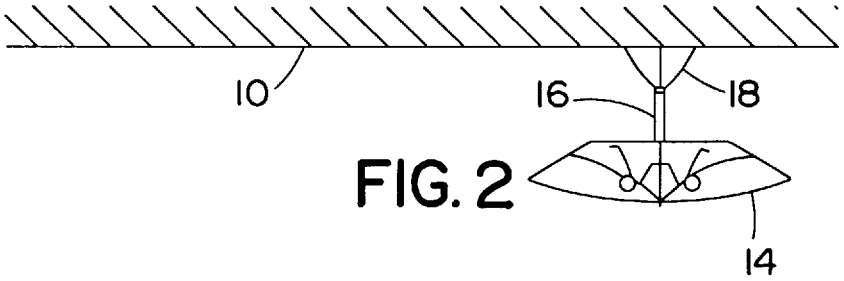
FIG. 2 is a diagrammatic view of the lamp according to FIG. 1 of a reduced scale.

Referring now to the drawings and particularly to FIG. 1 thereof, there is shown a lamp assembly in accordance with the present invention. The lamp assembly includes a relatively flat lamp housing (14) which in accordance with the embodiment shown in FIG. 1 is suspended from the ceiling by means of a short lamp shaft (16) and a generally conical ceiling dome (18). The distance A from the room ceiling (10) to the lower edge of the lamp housing (14) should be as short as possible and preferably no greater than 0.3 meters.

The bottom surface (20) of lamp housing (14) is slightly convex and is preferably made of a an opaque material. It can, however, consist of perforated plate or be provided with other types of openings to allow a predetermined selected amount of light to pass through as desired. The lower part (20) of lamp housing (14) is bent inwardly to define inwardly angled bent portions (22). The upper ends of the obliquely, upwardly and inwardly pointing portions (22) provide a support for a good light-transmitting upper part (24) of the lamp housing (14).

As best illustrated in FIG. 1, lamp housing (14) is symmetric about a vertical central plane (26) extending in the longitudinal direction of the lamp housing (14). An elongated, fluorescent tube (28) is mounted on each side of the central plane (26). As illustrated, the tubes (28) are the same distance from the central plane (26) and at the same height above lower part (20). In the illustrated embodiment, the tubes (28) are approximately at the level of bent sections (22) of lamp housing (14). A reflector (30) of generally strip-like configuration is mounted above each fluorescent tube (28). The reflector (30) has a downwardly facing concave surface **(30*a*) terminating a lower edge (30*b*) which rests at a point (32) against the upper half of the peripheral surface of the fluorescent tube (28) or is spaced a slight distance away from it in this region. In the embodiment illustrated in FIG. 1, the point (32) is located away from the apex line (34) of each tube toward the central plane (26). As illustrated, each reflector (30) has an angled flange (36) facing outwardly and downwardly from the upper edge of the concave front face of the reflector (30) which serves to stiffen the reflector in the longitudinal direction. The reflectors (30) are slightly convex in the upward and inward directions, that is, in the direction facing the central plane (26)** and slightly concave in the outward and downward directions.

The lamp assembly further includes a central reflector (38) in the area between the two reflectors (30) and the pair of the fluorescent tubes (28). The reflector (38) is symmetrical about the central plane (26) and comprises, as illustrated, an elongated generally rectangular top **(38*a*) opposing sidewalls (40) depending angularly downwardly and outwardly from opposing side edges of the top (38*a*). The reflector side surfaces (40) terminate at their lower edge in an inwardly angled flange section (42) pointing toward central plane (26). The inwardly slanting flat reflector surfaces (40) form an acute angle A which expands in the upward direction and as illustrated in vertical section, the angle A starts from the end of reflector (30)** closest to the central plane without consideration of its curvature.

Each reflector (30) serves essentially to divert most of the light from fluorescent tube (28) into an area defined by an angle B pointing out obliquely to the side and upward. The lower boundary or leg (44) of angle B is determined by the upper edge of the bent section (22) and the upper boundary or leg (46) is defined by the outer edge of angled section (36). Accordingly, the opening of angular area B can be adjusted within certain predetermined limits by changing variables, such as, the width of section (22), the width of angled section (36), and curvature of reflector (30).

The light radiated upwardly and inwardly from the fluorescent tube (28) toward the ceiling and toward the central plane (26) emerges over an angular range C, which is essentially directed upward toward the ceiling (10). The outer boundary or leg (48) of angle C is defined by the convex inside surface of reflector (30) whereas outer boundary or leg (50) is defined by the reflective surface (40) of reflector (38). Accordingly, it is possible to adjust the ratio of the amount of this light to the total radiated by fluorescent tube (28) by selectively varying the location of the point (32).

The light from fluorescent tube (28) which is not radiated upwardly and inwardly toward the ceiling as described above is directed downwardly onto the inside surface of the lower part (20) of lamp housing (14). Part of this light is reflected upwardly again, and a small percentage escapes downwardly through openings or through a perforated plate or the like. The angled flange section (42) of the central reflector (38) serves to make the illumination of lower part (20) more uniform and thus to achieve the uniform brightness effect when the lamp is observed from below.

To avoid too much intensity at reflector (30) (concave side), the reflectivity of an area (52) on the inside surface of lamp housing (14) can be reduced. The surface area (52) may be a painted surface or a strip of opaque material. This arrangement prevents excessive brightness when the lamp is viewed from a generally horizontal direction that is from the side in the direction of arrow D.

Figure 3:
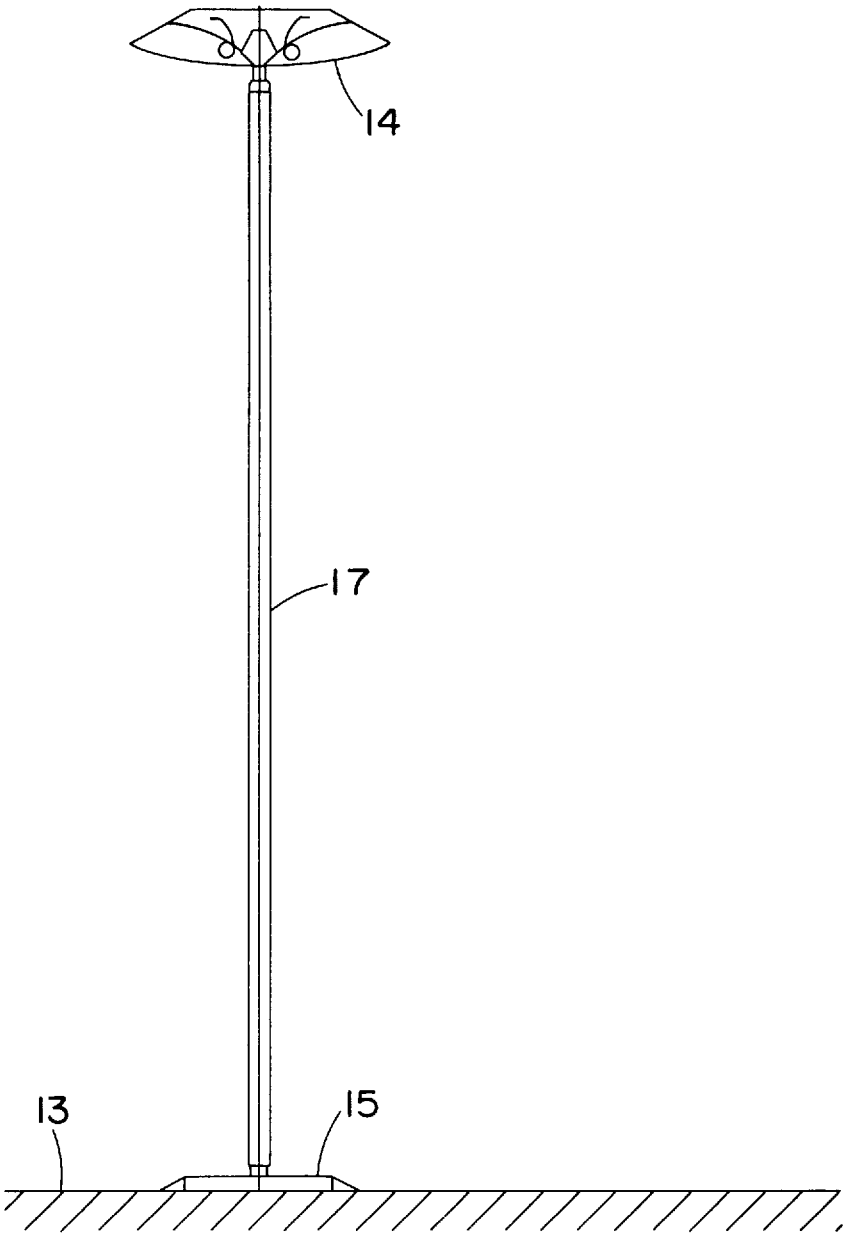
FIG. 3 shows a lamp according to the present invention mounted on a tall stand near the room ceiling.

FIG. 3 shows another embodiment of lamp in accordance with the present invention where the details of the lamp housing, reflectors and the fluorescent lamps are the same as that described in connection with FIG. 1. In this instance, the lamp housing is mounted on a tall stand (17) with the base (15) so that it can be floor mounted.

Even though particular embodiments of the present invention have been illustrated and described herein, it is not intended to limit the invention and changes and modifications may be made therein within the scope of the following claims.

What is claimed is:

1. A lamp assembly comprising;

an elongated lamp housing (14);

a pair fluorescent tubes (28) in the housing, one on either side of, and equidistant from a central plane (26);

at least one first reflector (30) in the lamp housing next to and parallel to each fluorescent tube;

said first reflector (30), seen in vertical cross section, slanting upwardly and away from the central plane (26) from a point (32) on the upper half of the circumference of the associated florescent tube (28);

a second reflector (38) in an area between the two first reflectors (30) and the two fluorescent tubes (28), symmetric to the central plane (26) of the lamp housing (14), said second reflector having two flat reflective surfaces (40); and whereby light is radiated upwardly and inwardly over an angular range C having boundaries defined by said first and second reflectors (30, 38).

2. A lamp assembly according to claim 1, wherein a point (32) on the upper half of the circumference of the fluorescent tube (28) is shifted from the apex line (32) of the tube toward the central plane (26) of the lamp housing (14).

3. A lamp assembly according to claim 1, wherein each reflector (30) is slightly convex on the side facing the central plane (26) of the lamp housing (14) and is correspondingly concave on the opposite side.

4. A lamp assembly according to claim 1, wherein on an end facing away from the associated fluorescent tube (28), each reflector (30) has an angled section (36) pointing away from the central plane (26) of the lamp housing (14).

5. A lamp assembly as claimed in claim 1 wherein the outer boundary of said angle C is defined by the convex inner surface of reflector (30) and the outer boundary of said angle C is defined by one of said reflector surfaces (40).

6. A lamp assembly according to claim 1, wherein each reflective surface (40) is provided at its lower end with an angled section (42), which points toward the central plane (26) of the lamp housing (14).

7. A lamp assembly according to claim 1, wherein the reflectivity of an inside surface of the lamp housing (14) is reduced in the area (52) seen in the reflection of the two reflectors (30).

8. A lamp assembly according to claim 1, wherein the lamp housing (14) has a light-transmitting upper part (24).

9. A lamp assembly according to claim 1, wherein the lamp assembly is it is suspended a short distance (A) away from a ceiling (10) of a room.

10. A lamp assembly according to claim 1, wherein the lamp assembly is mounted on a tall stand (17) close to the ceiling of a room (10).

* * * * *